US008069869B1

(12) United States Patent
Huang

(10) Patent No.: US 8,069,869 B1
(45) Date of Patent: Dec. 6, 2011

(54) CRUTCH AND A GRIP UNIT THEREOF

(76) Inventor: Miao-Yuan Huang, Xizhi (TW)

( * ) Notice: Subject to any disclaimer, the term of this patent is extended or adjusted under 35 U.S.C. 154(b) by 57 days.

(21) Appl. No.: 12/789,523

(22) Filed: May 28, 2010

(51) Int. Cl.
*A61H 3/02* (2006.01)

(52) U.S. Cl. ..... 135/72; 135/68; 135/76; 16/430

(58) Field of Classification Search ..... 135/65, 135/68, 72, 76; 403/109.2, 109.6, 110, 378, 403/379.5, 789.2; 248/188.5, 210–211, 219.3, 248/155.1; 16/421–422, 430, 114, 406
See application file for complete search history.

(56) References Cited

U.S. PATENT DOCUMENTS

| | | | | | |
|---|---|---|---|---|---|
| 705,741 | A | * | 7/1902 | Drew | 135/69 |
| 1,267,008 | A | * | 5/1918 | Stansbury | 135/71 |
| 1,296,042 | A | * | 3/1919 | Braluve | 403/379.2 |
| 1,446,009 | A | * | 2/1923 | Glowacki | 135/72 |
| 2,547,265 | A | * | 4/1951 | Hilgeman | 135/73 |
| 5,291,910 | A | * | 3/1994 | Bui et al. | 135/68 |
| 5,381,813 | A | * | 1/1995 | Miric et al. | 135/72 |
| 6,079,431 | A | * | 6/2000 | Su | 135/72 |
| 6,314,977 | B1 | * | 11/2001 | Obitts et al. | 135/68 |
| 7,066,676 | B2 | * | 6/2006 | Tsai | 403/109.3 |
| 7,069,940 | B2 | * | 7/2006 | Tsai | 135/72 |

FOREIGN PATENT DOCUMENTS

| | | | |
|---|---|---|---|
| JP | 09313554 | A * | 12/1997 |
| JP | 2000237253 | A * | 9/2000 |

* cited by examiner

*Primary Examiner* — Winnie Yip
(74) *Attorney, Agent, or Firm* — Alan Kamrath; Kamrath & Associates PA

(57) ABSTRACT

A crutch has a standing unit, an armpit rest and a grip unit. The standing unit has a top, a foot and multiple positioning holes defined between the top and the foot. The armpit rest is mounted on the top of the standing unit. The grip unit transversally attached to the standing unit has a grip, two positioning bases and two pins. The grip has two ends each having a recess, a pin hole and a limiting portion. Each positioning base has two insertions each having a limiting notch and a hook. When the positioning base engages the recess, the limiting notches combine with the limiting portions and the pin inserts into one corresponding positioning hole. When the positioning base is released from the recess, the limiting notches disengage from the limiting portions, the pin disengages from the positioning hole, and the hook combines with the limiting portion.

10 Claims, 7 Drawing Sheets

CRUTCH AND A GRIP UNIT THEREOF

BACKGROUND OF THE INVENTION

1. Field of the Invention

The present invention relates to a crutch and more particularly to a crutch that has an easy-operated grip unit.

2. Description of Related Art

As shown in FIG. 1, a grip unit 1 of one conventional crutch comprises a grip 11, a positioning base 12 and a pin 13. Wherein the grip 11 has two round distal end each having two sides, two limiting portions 111, 112 defined on each side of each round distal end, and a pin hole 113 defined transversally in each round distal end between the two sides. The positioning base 12 has two foot each having a hook 121 to operationally combine one of the two limiting portions 111, 112. When foot of the positioning base 12 insert into the grip 11, the hook 121 engages one (inner) limiting portion 111 and meanwhile the pin 13 inserts the pin hole 113 to fix the height of the grip unit 1. When the hook 121 of the positioning base 12 move outward slightly inside the grip 11, the hook 121 engages another (outer) limiting portion 112 and meanwhile the pin 13 disengages from the pin hole 113 so that the user enables to adjust height of the grip unit 1. However, the hook 121 and the corresponding two limiting portions 111, 112 conventional grip unit 1 are operationally engaged with small contacting area so that the hook 121 easily disengage from the limiting portion 112 when the user over forces and thus the positioning base 12 completely disengages from the grip 11. Therefore, the conventional grip unit 1 is inconvenient in use.

As shown in FIG. 2, a grip unit 2 of another conventional crutch comprises a grip 21, a positioning base 22 and a pin 23. Wherein the grip 21 has two round distal end each having recess 211 to provide combination with a hook 221 of the positioning base 22. However, when user wants to adjust height of the grip unit 2 by releasing the positioning base 22, the hook 221 completely disengages from the recess 211 so that the positioning base 22 also completely is separated from the grip 21. Therefore, the user has to hold the grip 21 with one hand and take the positioning base 22 with the other hand so that this conventional crutch unit is inconvenient in use.

SUMMARY OF THE INVENTION

A main objective of the present invention is to provide a crutch that is convenient in use, especially in adjustment of a grip unit.

To achieve the foregoing objective, the crutch in the present invention comprises:

- a standing unit having a top and a foot, and multiple positioning holes defined between the top and the foot;
- an armpit rest mounted on the top of the standing unit; and
- a grip unit transversally connected to the standing unit, located between the top and the foot, and having:
  - a grip having a recess, a pin hole and a limiting portion;
  - a positioning base having a limiting notch and a hook; and
- a pin, wherein when the positioning base inserts into the recess, the limiting notch engages with the limiting portion, the pin penetrates the pin hole and a corresponding one of the multiple positioning holes; when the positioning base withdraws from the recess, the limiting notch separates from the limiting portion, the pin separates from the pin hole and the corresponding one of the multiple positioning holes, and the hook engages with the limiting portion.

Further benefits and advantages of the present invention will become apparent after a careful reading of the detailed description with appropriate reference to the accompanying drawings.

DETAILED DESCRIPTION OF THE PREFERRED EMBODIMENT

A crutch in the present invention has a standing unit, an armpit rest and a grip unit. The standing unit has a top, a foot and multiple positioning holes defined thereon between the top and the foot. The armpit rest is mounted on the top of the standing unit. The grip unit transversally attached to the standing unit between the top and the foot of the standing unit has a grip, two positioning bases and two pins. The grip has two ends each having a recess, a pin hole and a limiting portion. Each positioning base has two insertions each having a limiting notch and alternatively a hook. When the positioning base engages the recess, the limiting notches combine with the limiting portions and the pin inserts through the pin hole and one corresponding positioning hole. When the positioning base is released from the recess, the limiting notches disengage from the limiting portions, the pin disengages from the pin hole and the corresponding positioning hole and the hook combines with the limiting portion.

Figure 3:
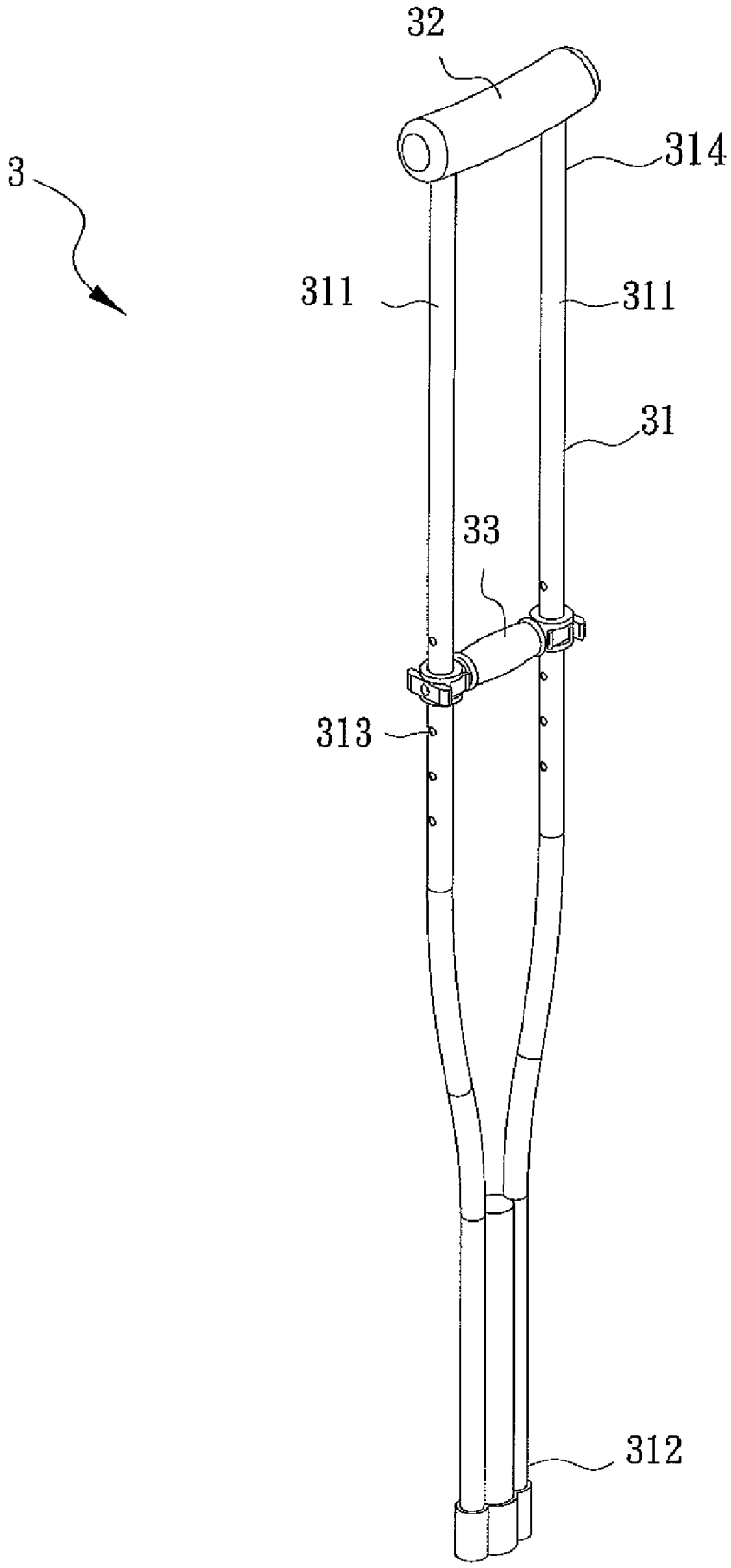
FIG. 3 is a perspective view of the crutch in accordance with the present invention.

As shown in FIG. 3, a preferred embodiment of the crutch 3 in accordance with the present invention comprises a standing unit 31, an armpit rest 32 and a grip unit 33. The standing unit 31 abuts the ground and is not limited in the shape or material. The standing unit 31 has two standing rods 311 separated and arranged in parallel at a top. The standing rods 311 extend from the armpit rest 32 to the grip unit 33 and further extend to a foot 312 of the standing unit 31 at which combined by another element. In other embodiments, the standing unit 31 is shaped in one-piece. Additionally, the standing unit 31 has multiple positioning holes 313 defined thereon between the top 314 and the foot 312. The positioning holes 313 enable the user to decide the height of the grip unit 33 at preference.

The armpit rest 32 is mounted on the top 314 of the standing unit 31. The armpit rest 32 is for supporting the user and is not limited in shape or material. The armpit rest 32 is mounted on the top 314 of the standing unit 31 and the top 314 has a height not higher than one of the armpit rest 32. In other embodiments, the height of the top 314 is selectively higher than one of the armpit rest 32. Moreover, the height of the armpit rest 32 is adjustable, for example, by a locking element to make the armpit rest 32 loosen or fastened to the standing unit 31.

Figure 4:
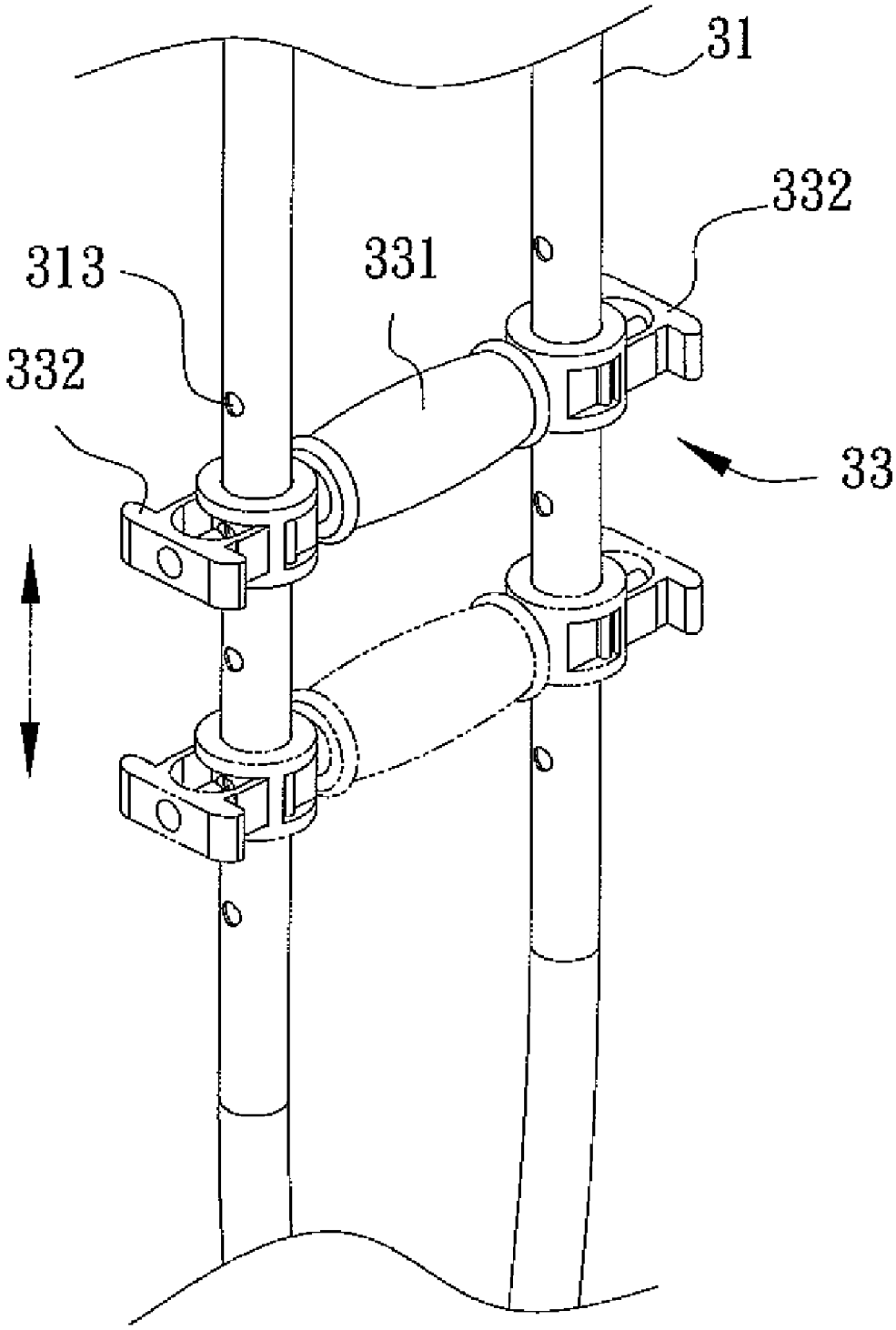
FIG. 4 is an operationally perspective view of a grip unit in the crutch in accordance with the present invention.

The grip unit 33 is transversally combined to the standing unit 31 between the top 314 and the foot 312. The grip unit 33 is for the user's holding or placing hand and is not limited in shape and material. The user adjusts the grip unit 33 relative to the standing unit 31 by securing to different positioning holes 313. As shown in FIG. 4, when two positioning bases 332 of the grip unit 33 disengage the grip 331 of the grip unit 33, the grip unit 33 is adjustable in height. Particularly, the positioning bases 332 in this preferred embodiment does not completely separate from the grip 331 so that the user does not need to hold the standing unit 31 by one hand and take the positioning base 332 by the other hand and is easy in operation when adjusting heights of the grip unit 33. The following illustrates the technical features of the grip unit 33 in this preferred embodiment.

Figure 5:
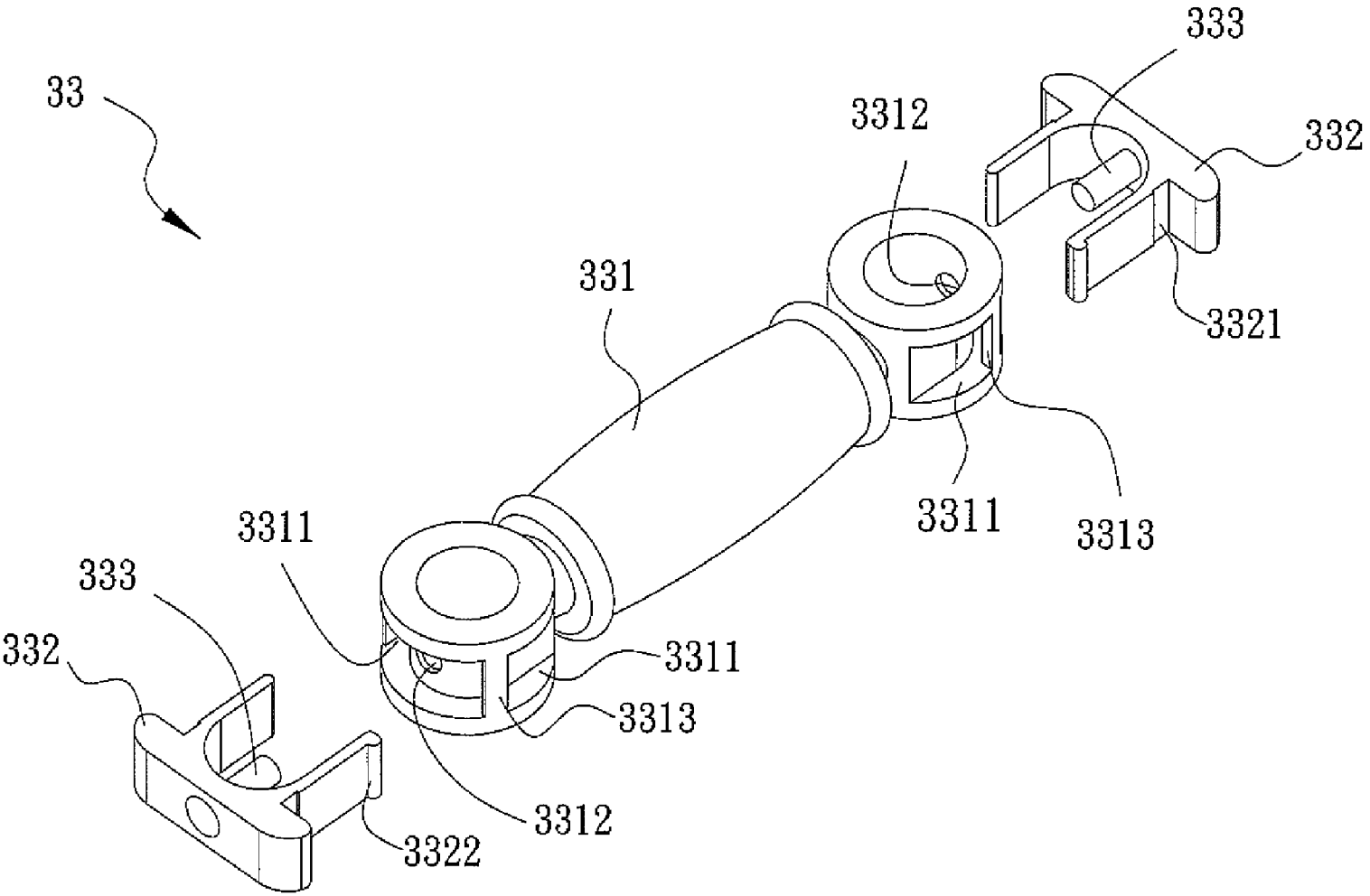
FIG. 5 is an exploded perspective view of the grip unit in FIG. 4.
Figure 6:
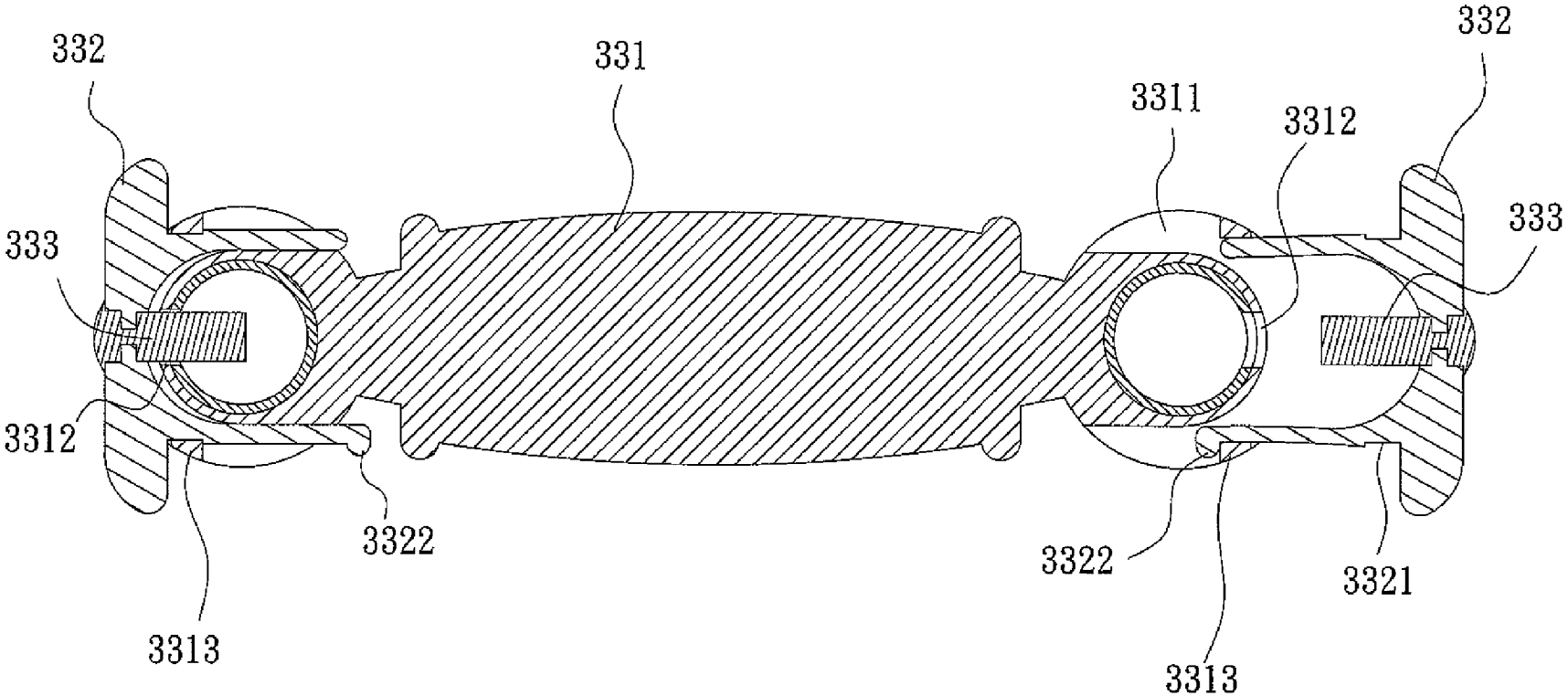
FIG. 6 is a cross-sectional view of the grip unit.

As shown in FIGS. 5 and 6, FIG. 5 is an exploded perspective view of the grip unit 33 and FIG. 6 is a cross-sectional view of the grip unit 33. The grip unit 33 has the grip 331, two positioning bases 332 as described above and further has two pins 333. Wherein the grip 331 has two ends each having a recess 3311, a pin hole 3312 and two limiting portions 3313. Each of the two positioning bases 332 has two insertions each with a limiting notch 3321 and has a hook 3322. Therefore, each of the positioning bases 332 is U-shape and the hook 3322 is formed on a distal end of one insertion of the U-shape. The two pins 333 are respectively attached to the two positioning bases 332. Combination of the two pins 333 and the positioning bases 332 is in one-piece or detachable. In this preferred embodiment, the pins 333 and the positioning bases 332 are integrated in one-piece and the pins 333 extend toward the grip 331.

Relative movement of each positioning base 332 and the grip 331 is shown in FIG. 6. In FIG. 6, one positioning base 332 is locked to the grip 331 and the other positioning base 332 is released from the grip 331. When the user wants to fix the height of the grip unit 33 to make the positioning base 332 (the positioning base 332 at left side in FIG. 6) engages the recess 3311, the limiting notches 3321 combine with the limiting portions 3313 and the pin 333 inserts into the pin hole 3312 and one corresponding positioning hole 313 (as shown in FIGS. 3 and 4). Meanwhile, by engaging the limiting notch 3321 to the limiting portion 3313, the pin 333 penetrates the pin hole 3312 and one corresponding positioning holes 313 to make the positioning base 332 secured on the grip 331 and to make the grip unit 33 secured on the standing unit 31. Particularly, before the positioning base 332 inserts into the recess 3311, the positioning base 332 slightly rotates along with a direction perpendicular to a longitudinal axle of the grip unit 33 to enter the recess 3311 to facilitate the hook 3322 of the positioning base 332 enter the recess 3311.

Figure 7:
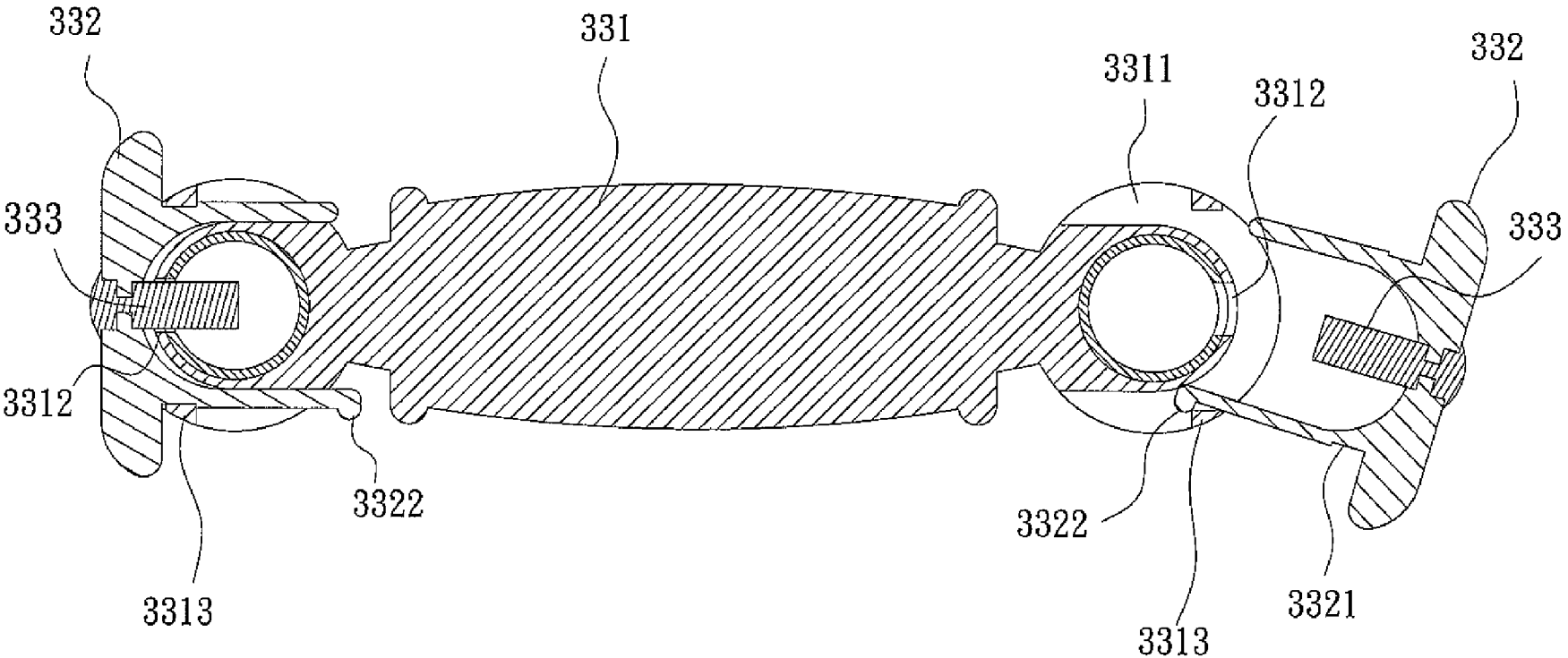
FIG. 7 is an operationally cross-sectional view of the grip unit, wherein one positioning base is detached.

When the user adjusts the height of the grip unit 33, the positioning base 332 (the positioning base 332 at the right side in FIG. 6) disengages from the recess 3311, the limiting notches 3321 disengage from the limiting portions 3313, and the pin 333 withdraws from the pin hole 3312 and the positioning hole 313. Meanwhile, the hook 3322 still engages with the limiting portion 3313 to make the positioning base 332 not completely separated from the grip 331. In this FIG. 6, the hook 3322 is operationally engaged with the limiting portion 3313 as example. When the user wants to completely separate the positioning base 332 from the grip 331, the positioning base 332 as shown in FIG. 7 is first pulled aside to make one insertion (the insertion having no hook 3322) separated from the grip 331 and then the insertion with the hook 3322 is easily disengaged from limiting portion 3313 of the grip 331 to make the positioning base 332 completely separated from the grip 331.

It is noticed that, the hook 3322 and the limiting notch 3321 on the same insertion shall be spaced with a proper distance to make the limiting notch 3321 disengaged from the limiting portion 3313, to make the pin 333 disengaged from the pin hole 3312 and the corresponding positioning hole 313, and to make the hook 3322 engaged with the limiting portion 3313 available when the positioning base 332 withdraws from the recess 3311.

Figure 1:
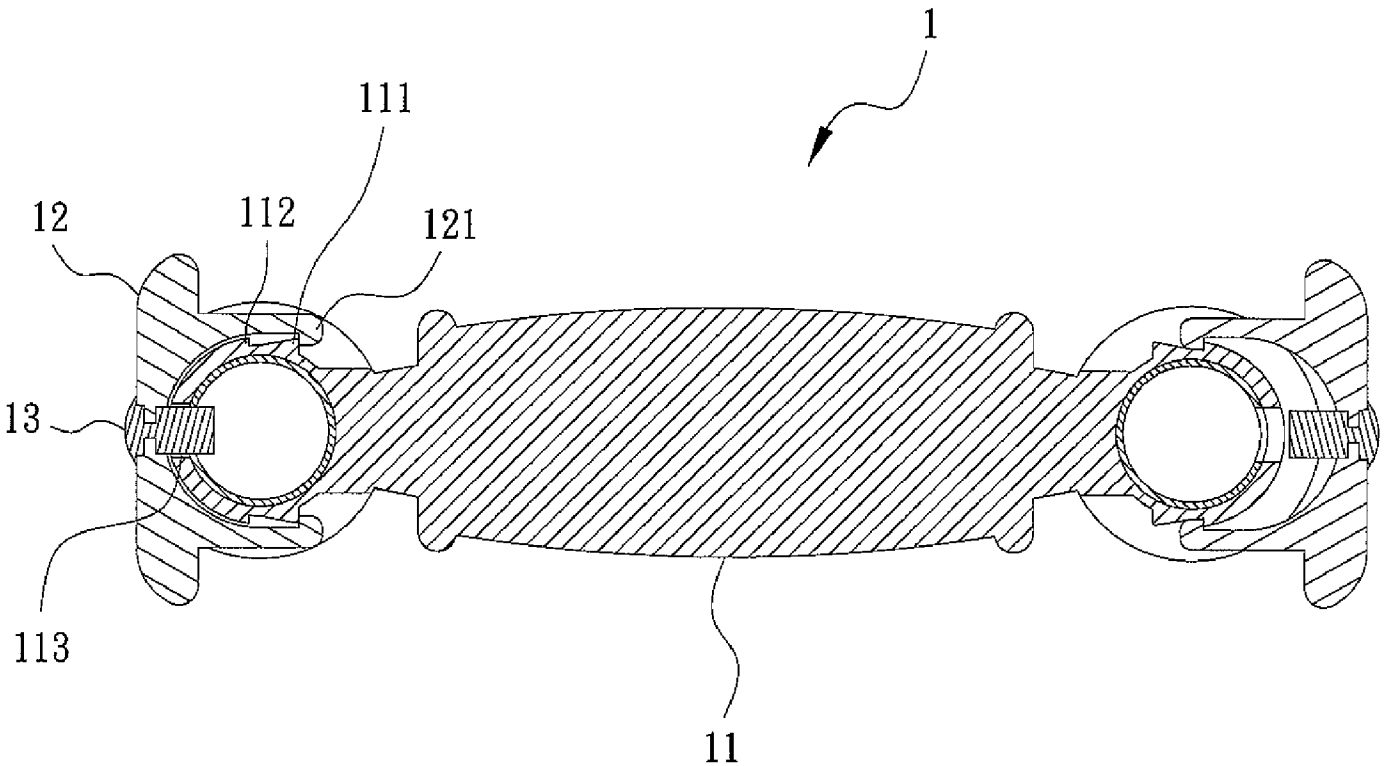
FIG. 1 PRIOR ART
FIG. 1 is cross-sectional view of a grip unit of one conventional crutch in accordance with the prior art.
Figure 2:
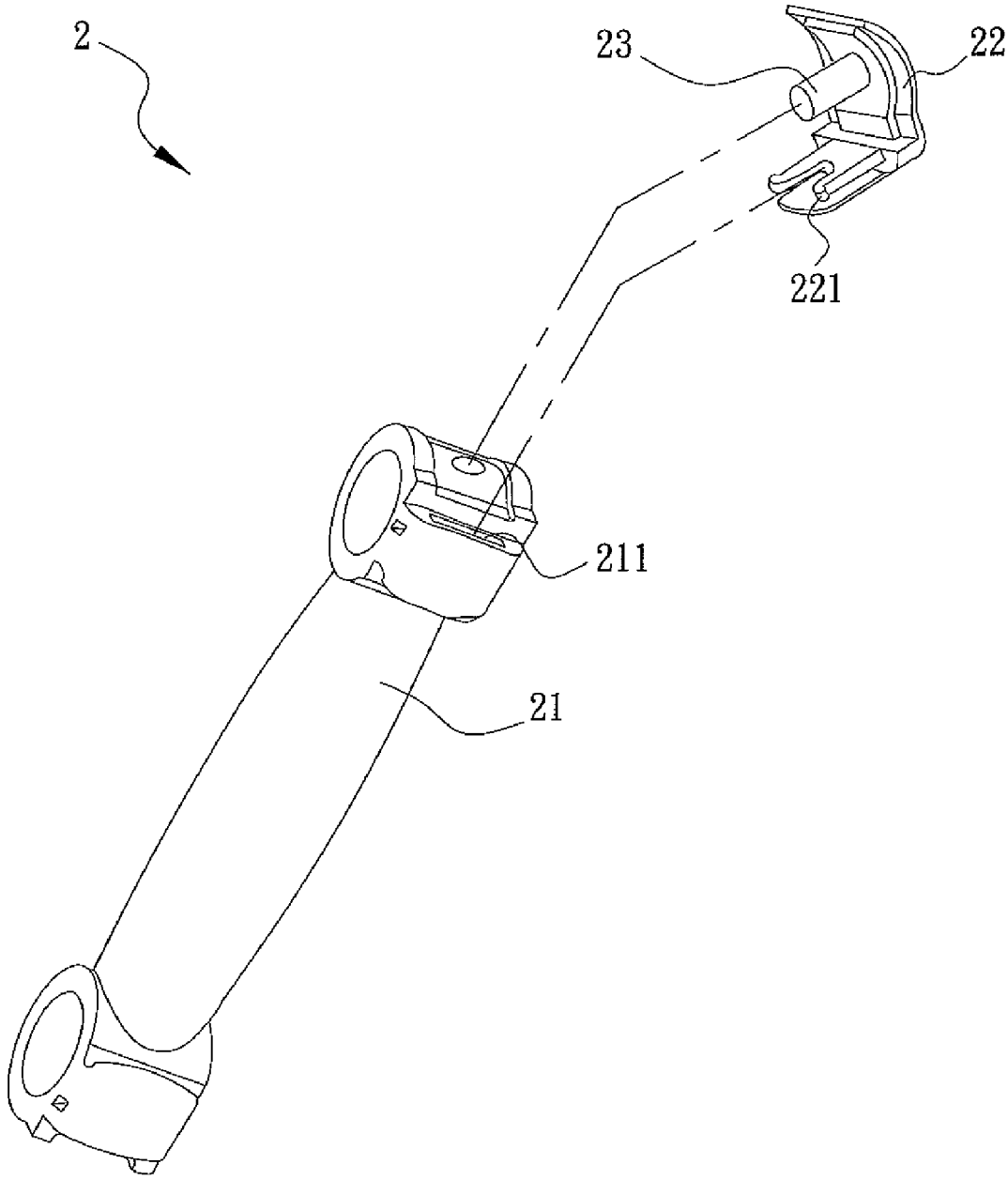
FIG. 2 PRIOR ART
FIG. 2 is an exploded perspective view of a grip unit of another conventional crutch in accordance with the prior art.

According to above description, the crutch in the present invention has the limiting notch, the limiting portion and the hook to make the limiting notch engaged with the limiting portion and to make the pin inserted into the pin hole and a corresponding one of multiple positioning holes when the positioning base inserts into the recess. When the positioning base withdraws from the recess, the limiting notches disengages from the limiting portions, the pin disengages from the pin hole and the corresponding positioning hole, and the hook engages with the limiting portion. In comparison with the conventional crutches having a hook and two limiting portions (as shown in FIG. 1) or a hook and a recess (as shown in FIG. 2), the crutch in the present invention is functioned by having the limiting notches, the limiting portions and the hook. When the positioning base inserts into the recess, the limiting notch has a large area to contact with the limiting portion for securing. Therefore, when one positioning base withdraws from the recess, the engagement of the hook and the limiting portion is performed by larger area to make the combination stable and prevent disengagement automatically inadvertently from the limiting portion to improve the utility of the crutch.

Although this invention has been described in its preferred form with a certain degree of particularity, it is understood that the present invention of the preferred form has been made only by way of example and that numerous changes in the details of construction and the combination and arrangement of parts any be resorted to without departing from the spirit and scope of the invention.

What is claimed is:

1. A crutch, comprising:

a standing unit having a top and a foot, and multiple positioning holes defined between the top and the foot;

an armpit rest mounted on the top of the standing unit; and a grip unit transversally connected to the standing unit, located between the top and the foot, and having:

a grip with at least one end having a recess, a pin hole and two limiting portions;

at least one positioning base having a U-shape configuration with two insertions each having a limiting notch and a hook, the hooks of two insertions extending outwardly and away from each other, and the positioning base correspondingly attached to the at least one end of the grip; and a pin formed on each of the at least one positioning base, wherein when each positioning base inserts into the recess, the limiting notch engages with the limiting portion, the pin penetrates the pin hole and a corresponding one of the multiple positioning holes; when the positioning base withdraws from the recess, the limiting notch separates from the limiting portion, the pin separates from the pin hole and the corresponding one of the multiple two insertions of the positioning holes, and the hook engages with the limiting portion.

2. The crutch as claimed in claim 1, wherein the standing unit has two standing rods spaced apart in parallel and extends to the grip unit.

3. The crutch as claimed in claim 1, wherein the grip has two ends; and two positioning bases respectively attached to the two ends of the grip.

4. The crutch as claimed in claim 1, wherein the pin and the positioning base are integrated in one-piece or detachable.

5. The crutch as claimed in claim 1, wherein the hook is formed at a distal end of one of the two insertions.

6. The crutch as claimed in claim 1, wherein the limiting portion and the limiting notch are engaged with each other.

7. The crutch as claimed in claim 1, wherein the hook and the limiting notched are spaced with a distance to make the positioning base disengaged from the recess, the limiting notch disengaged from the limiting portion, the pin withdrawn from the pin hole and the positioning hole, and the hook engaged with the limiting portion available.

8. A grip unit of a crutch, comprising:

a grip with at least one end having a recess, a pin hole and two limiting portions;

at least one positioning base having a U-shape configuration with two insertions each having a limiting notch and a hook, the hooks of two insertions extending outwardly and away from each other, and the positioning base correspondingly attached to the at least one end of the grip; and a pin formed on each of the at least one positioning base, wherein when each two insertions of the positioning base inserts into the recess, the limiting notch engages with the limiting portion, the pin penetrates the pin hole and a corresponding one of the multiple positioning holes; when the positioning base withdraws from the recess, the limiting notch separates from the limiting portion, the pin separates from the pin hole and the corresponding one of the multiple positioning holes, and the hook engages with the limiting portion.

9. The grip unit as claimed in claim 8, wherein the hook is formed at a distal end of one of the two insertions.

10. The grip unit as claimed in claim 8, wherein the hook and the limiting notched are spaced with a distance to make the positioning base disengaged from the recess, the limiting notch disengaged from the limiting portion, the pin withdrawn from the pin hole and the positioning hole, and the hook engaged with the limiting portion available.

* * * * *